United States Patent [19]

Jansma

[11] 4,168,224

[45] Sep. 18, 1979

[54] COKING DRUM AND PROCESS FOR FORMING IMPROVED GRAPHITE COKE

[75] Inventor: John C. Jansma, Middleburg Heights, Ohio

[73] Assignee: The Standard Oil Company (Ohio), Cleveland, Ohio

[21] Appl. No.: 768,293

[22] Filed: Feb. 14, 1977

[51] Int. Cl.[2] ..... C10G 9/16; C10G 9/18; C10B 39/06

[52] U.S. Cl. ..... 208/131; 134/24; 134/39; 134/166 R; 134/167 R; 201/2; 201/39; 202/227; 202/241; 202/253

[58] Field of Search ..... 208/131, 48 Q; 201/2, 201/39; 202/221, 227, 241, 253; 134/22 R, 22 C, 24, 39, 166 R, 166 C, 169 R, 169 C, 167 R

[56] References Cited

U.S. PATENT DOCUMENTS

| | | | |
|---|---|---|---|
| 2,302,299 | 11/1942 | Court | 134/167 R |
| 2,778,781 | 1/1957 | Smith | 202/221 |
| 2,837,470 | 6/1958 | Hayden | 202/227 |
| 2,876,865 | 3/1959 | Cobb | 208/103 |
| 3,103,485 | 9/1963 | Cahn | 208/130 |
| 3,674,679 | 7/1972 | Washimi et al. | 208/48 Q |
| 3,836,434 | 9/1974 | Novy | 134/24 |
| 3,963,358 | 2/1976 | Little | 208/131 |

*Primary Examiner*—Herbert Levine

*Attorney, Agent, or Firm*—William D. Mooney; Herbert D. Knudsen; Larry W. Evans

[57] ABSTRACT

Cooling water for cooling coke in a coking drum is charged into the interior of the coking drum from a plurality of orifices located on the lateral surfaces of the coking drum so as to uniformly distribute the cooling effect provided by the cooling water.

11 Claims, 1 Drawing Figure

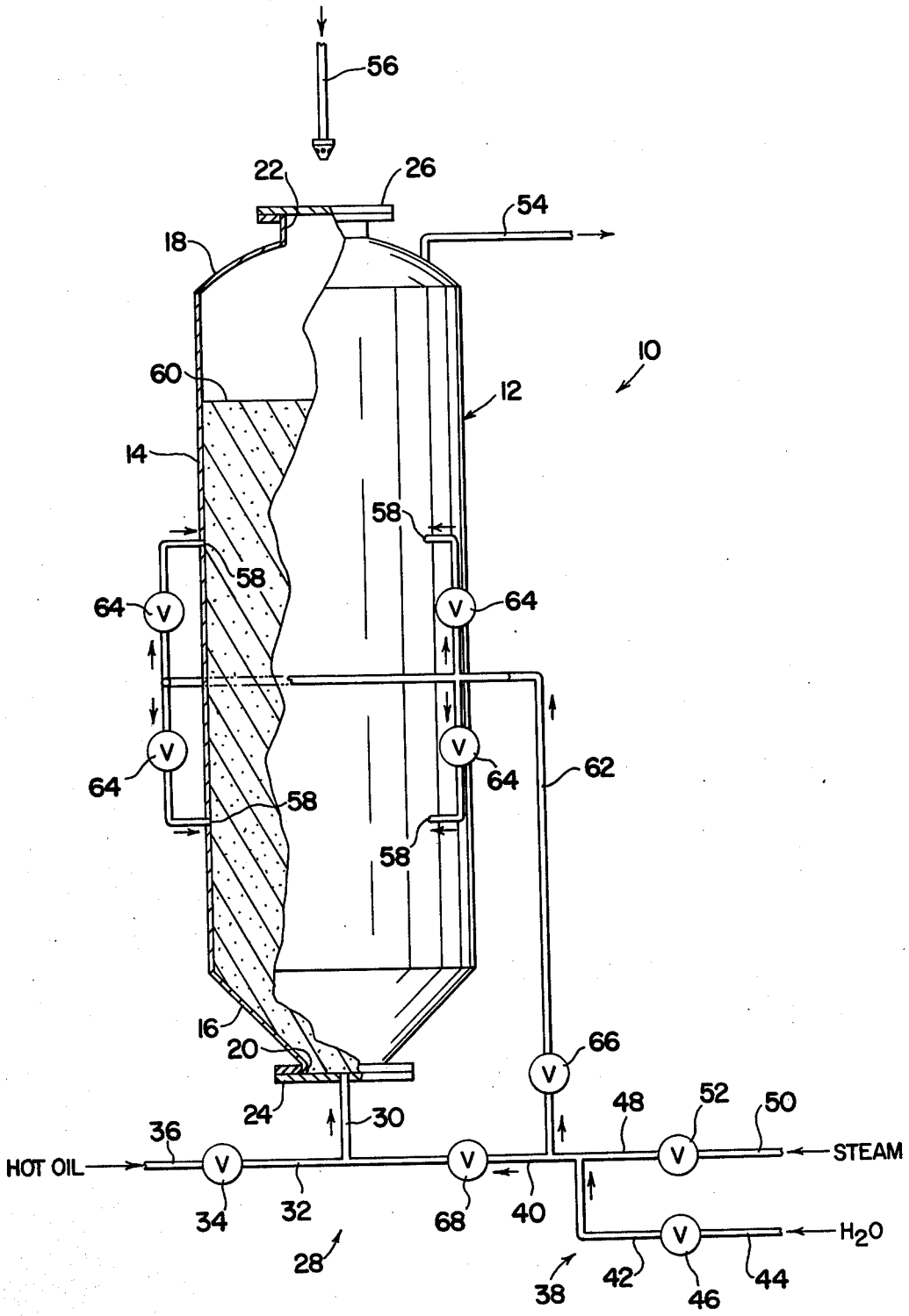
56
22
26
54
18
10
60
12
14
58
58
64
64
64
64
62
58
58
16
20
66
24
30
48
52
50
36
HOT OIL
STEAM
34
32
68
40
28
38
42
46
44
$H_2O$

COKING DRUM AND PROCESS FOR FORMING IMPROVED GRAPHITE COKE

BACKGROUND OF THE INVENTION

The present invention relates to an improved process and apparatus for forming coke and especially graphite coke.

Processes for forming coke from petroleum hydrocarbons are well known. See, for example, U.S. Pat. Nos. 3,745,110 and 3,836,434, the disclosures of which are incorporated herein by reference. Such processes involve heating certain petroleum hydrocarbon streams to elevated temperatures, for example 925° to 975° F., and rapidly running the hot hydrocarbons into a relatively quiescent chamber known as a "coking drum." As the hydrocarbons are charged into the coking drum, they undergo coking, i.e., they change state from a liquid to an extremely viscous plastic semi-solid.

When charging of the coking drum with hydrocarbon is completed, it is customary to introduce steam into the bottom of the coking drum. This procedure, referred to as "steam stripping" drives off non-coked hydrocarbons, i.e., portions of the hydrocarbon feed which have not coked. The steam stripping period also allows time for coking of the most recently charged hydrocarbon. In addition, steam stripping provides some cooling of the very hot mass of coke in the coking drum.

After steam stripping, the coke is cooled to a relatively low temperature, i.e., about 200° F. or less, so that it can be safely removed from the coking drum. This is accomplished by charging water into the bottom of the coking drum. During early stages of water cooling water charged into the coking drum is immediately converted into steam which may build to dangerously high pressures. Therefore, care must be taken to adjust the water flow rate during water cooling to prevent high pressures from developing in the coking drum.

When the water cooling operation is completed, the coking drum is ready for emptying. This is accomplished by removing covering plates at the top and bottom of the coking drum called "heads" and breaking up the hardened coke into chunks. Break-up of the coke is normally accomplished by means of high pressure water drills which direct jets of high pressure water into the coke and thereby break up the coke into chunks or pieces. The chunks of coke so formed fall through the bottom of the coking drum into railroad cars or other suitable conveyors for conveyance to calciners or other buyers.

Coke which is removed from coking drums is referred to as "green coke" and still contains molecules which will "crack" at elevated temperatures. Customarily, green coke is subjected to calcination at elevated temperature to cause these reactions to occur and hence complete the coking operation, thereby producing finished petroleum coke.

One of the widest uses for petroleum coke is in the manufacture of carbon electrodes for use in the manufacture of steel and aluminum. Carbon electrodes used for the manufacture of aluminum can be made from most types of coke. However, carbon electrodes for use in the steel industry normally must be made from graphite coke, which is a special type of coke characterized by having a needle-like quasi crystalline structure and which is made from petroleum streams rich in aromatics and substantially free of asphaltines. As is known, it is possible to produce carbon electrodes having co-efficients of thermal expansion of $4.0\times10^{-7}/°$ C. or less if graphite coke is used as a raw material. However, if non-graphite coke is used the electrodes will have co-efficients of thermal expansion on the order of 6to $10\times10^{-7}/°$ C. Since it is necessary for electrodes used in the steel industry to have low co-efficients of thermal expansion, only those electrodes made from graphite coke are acceptable to the steel industry.

Unfortunately, the use of graphite coke as a starting material in the manufacture of carbon electrodes will not always guarantee that the carbon electrodes produced have co-efficients of thermal expansion of less than $4.0\times10^{-7}/°$ C. In this conection, it has been found that some carbon electrodes produced from graphite carbon and otherwise correctly processed have co-efficients of thermal expansion significantly above $4.0\times10^{-7}/°$ C. This phenomenon is believed due to the character or quality of the graphite-based green coke which is calcined and then processed into the carbon electrodes. However, at the present time there is no reliable analytical procedure which can be used to determine if a particular batch of graphite-based green coke is of acceptable quality and character.

Accordingly, it is an object of the present invention to provide an improved technique for manufacturing graphite-based green coke which will form carbon electrodes having a lower co-efficient of thermal expansion than current practice, preferably a co-efficient of thermal expansion of $4.0\times10^{-7}/°$ C. or less for a higher percentage of on-stream operations.

SUMMARY OF THE INVENTION

According to the present invention, this object is accomplished by carrying out the coking of a liquid petroleum hydrocarbon stream rich in aromatics in a coking drum which is provided along its lateral surfaces with a plurality of orifices for the introduction of coking water. Rather than injecting water into the coking drum during water cooling only from the bottom of the drum, water is injected into the coking drum in accordance with the present invention from these orifices instead of or in addition to the bottom of the coking drum. By charging water used for cooling the drum in this manner, the cooling operation is effected in a more nearly uniform manner. This in turn causes the graphite coke to form its needle-like quasi-crystalline structure in a more nearly uniform fashion which in turn causes the entire mass of green coke produced by each operation of the coking process to be more nearly uniform in properties. Because the entire batch of coke (which may be on the average of 400 tons) has more nearly uniform properties, the graphite electrodes produced therefrom will always tend to have the improved characteristics.

Thus, the present invention provides a process for uniformly cooling coke in a coking drum which comprises directing cooling liquid at the interior of the coking drum from a plurality of orifices located at the lateral surfaces of the coking drum so as to uniformly distribute the cooling effect provided by the cooling liquid to the coke in the drum.

More specifically, the present invention provides a process for producing coke, preferably green coke, in which a liquid hydrocarbon is charged into a coking drum having a top, a bottom and lateral surfaces there between, the liquid hydrocarbon is allowed to transform itself into coke, the coke in the coking drum is cooled by introducing a cooling liquid into the coking drum, and the coke in the coking drum is broken into pieces and removed from the coking drum as green coke; the improvement in accordance with the present invention comprising directing the cooling liquid at the coke during coke cooling from a plurality of orifices located at the lateral surfaces of the coking drum so as to uniformly distribute the cooling effect provided by the cooling liquid to the coke in the coking drum.

In addition, the present invention further provides an improved coking drum for forming green coke, the coking drum having a top, a bottom, lateral surfaces between the top and bottom and cooling means for directing cooling liquid at the interior of the cooling drum, the improvement according to the present invention wherein the cooling means includes a plurality of orifices for directing cooling liquid into the interior of the coking drum, the orifices being located on the lateral surfaces of the coking drum so as to uniformly distribute the cooling effect provided by the cooling fluid to the coke in the coking drum.

More specifically, the present invention also provides an improved apparatus for producing green coke from a liquid hydrocarbon comprising a coking drum having a top, a bottom, and lateral surfaces therebetween, charging means for charging liquid hydrocarbon into the coking drum for forming coke, cooling means for cooling the coke in the coking drum by means of a cooling liquid, and break-up means in operative relation with the coking drum for breaking up the coke in the coking drum into pieces thereby forming green coke, the improvement in accordance with the present invention wherein the cooling means includes a plurality of orifices for directing cooling liquid into the interior of the coking drum, the orifices being located on the lateral surfaces of the coking drum so as to uniformly distribute the cooling effect provided by the cooling fluid to the coke in the drum.

BRIEF DESCRIPTION OF THE DRAWING

The sole FIGURE is a schematic view of an improved apparatus for producing coke in accordance with the present invention.

DETAILED DESCRIPTION

In accordance with the present invention, green coke is formed in an apparatus such as illustrated in the sole FIGURE at 10. This apparatus comprises coking drum 12 which is formed from body member 14, truncated conical base 16 and top 18. In the embodiment shown, body member 14 is generally cylindrical in shape and defines the lateral surfaces of coke drum 12. Body member 14 together with base 16 and top 18 define a closed chamber in which the coking occurs.

Base 16 and top 18 are provided with suitable openings 20 and 22 respectively, which are releasably sealed with bottom head 24 and top head 26, respectively. In order to charge hot oil into the interior of coking drum 12, the apparatus is provided with hot oil charging means at 28 which takes the form of conduits 30, 32 and 36 and valve 34. Conduit 36 communicates with a source of oil (not shown), while conduit 30 communicates with the interior of coking drum 12 via bottom opening 20 and bottom head 24 so that when valve 34 is opened hot oil will flow into the interior of coking drum 12.

In order to supply cooling liquid such as water to the interior of coking drum 12, the apparatus if further provided with cooling means 38 which takes the form of conduits 40, 42 and 44 and control valve 46. Conduit 44 is attached to a source of water or other cooling liquid (not shown), while conduit 40 is attached to conduit 30 so that when valve 46 is opened cooling liquid is charged into the interior of coking drum 12.

In order to supply steam to the interior of coking drum 12 via bottom opening 20, the apparatus is further provided with conduits 48 and 50 and control valve 52 which are in communication with a source of steam (not shown).

Attached to top 18 of coking drum 12 is outlet conduit 54, which is provided to take off vaporous components of the hot oil stream fed to coking drum 12 which do not undergo coking and cracked products. Also, suitable break-up means 56 such as a water drill is positioned above upper opening 22 in operative relation with coking drum 12 for removing coke once the coking operation has been completed.

In accordance with the present invention, coking drum 12 is provided with a plurality of liquid supply orifices 58 for supplying cooling liquid to the interior of coking drum 12 during coke cooling. Orifices 58 are located on the lateral surfaces of the coking drum and are arranged so as to uniformly distribute the cooling effect provided by the cooling liquid charged into the coking drum. In the embodiment shown, orifices 58 are arranged in two vertically spaced levels, with each level containing 4 orifices spaced 90° apart from one another. The vertical spacing of the orifices is such that the difference between the two orifice levels, the distance from the upper orifice level to the maximum fill line 60 of coke drum 12 and the distance between the lower orifice level and the bottom of body member 14 are about equal.

Water or other cooling liquid is supplied through orifices 58 by means of a conduit system 62 and valve 66 attached to conduit 40 of the cooling liquid supply system. Control valves 64 associated with each of orifices 58 are provided to regulate the flow of liquid through the individual orifices. Preferably, valves 64 are adjusted so that the cooling liquid flow rate through each of orifices 58 is the same. Control valve 46 is provided so that the relative flow of cooling liquid through orifices 58 with respect to the flow of cooling liquid through bottom opening 20 of coking drum 12 can be controlled.

In operation, the inventive coke forming apparatus is used in essentially the same way as conventional coke-forming apparatus. Thus, hot liquid petroleum hydrocarbon is charged into coking drum 12 and allowed to form a very viscous plastic mass of coke in the normal manner. However, in order to prevent orifices 58 from being clogged during the fill period, it is preferable to flow steam through orifices 58 at a suitable pressure, temperature and flow rate.

When the fill procedure is completed, the contents of the drum are subjected to steam stripping for a period of about ½ to 2 hours in accordance with the usual procedure. However, rather than feeding all of the steam through bottom opening 20 of coking drum 12, a portion of the steam is fed via orifices 58. Preferably, the steam flow rates of all of the orifices 58 as well as bottom opening 20 are suitably controlled.

When steam stripping is completed, the coke in the coke drum 12 is cooled by means of a cooling liquid, preferably water. In accordance with the present invention, this is accomplished by charging the cooling water into the interior of coking drum 12 via orifices 58 instead of or in addition to bottom opening 20. Preferably, the flow rates of water through each of orifices 58 and bottom opening 20 are suitably controlled. As in conventional practice, the flow rate of all the water fed to coking drum 12 during the initial stages of liquid cooling is relatively low so that dangerously high steam pressures are avoided. Thereafter, the flow rate of cooling liquid can be increased.

When the coke in coking drum 12 has been cooled to a safe temperature (i.e. about 200° F. or below), bottom head 24 and top head 26 are detached and the coke in coking drum 12 is removed therefrom in a conventional manner by means of break-up means 56.

In accordance with the present invention, the cooling liquid used for cooling the contents of coking drum 12 is supplied from a plurality of orifices located on the lateral surfaces of the drum. As a result, green coke made in accordance with the present invention will have more nearly uniform properties as well as overall improved properties and hence graphite electrodes made from graphite-based green coke produced by the present invention will always tend to have a co-efficient of thermal expansion of $4.0\times10^{-7}/°$ C. or less.

Although not wishing to be bound to any theory, it is believed that the uniformity in properties exhibited by the green coke produced by the present invention is due to the fact that each individual area or domain in the very viscous plastic hydrocarbon mass in the coking drum is cooled essentially the same way that other areas or domains of hydrocarbon are cooled. Thus, essentially all areas or domain of the mass of hydrocarbon in the coking drum are subjected to conditions which will facilitate the formation of the appropriate structure, i.e., the needle structure in the case of graphite coke. In prior art processes, water which is introduced into the bottom of the coking drum and which immediately vaporizes into steam causes cracks and fissures in the hydrocarbon mass and by this technique forms a path through the coke mass to the top of the coking drum where it exits through the outlet conduit. In the inventive process, it is believed that water introduced into coking drum 12 via orifices 58 as well as bottom opening 20 also forms cracks and fissures in the hydrocarbon mass. However, because the amount of water fed to the coking drum through each of orifices 58 and bottom opening 20 is much less than the total amount of water fed to the bottom opening in prior art processes, and because the cooling water is introduced into the coking drum from a variety of different locations, a much greater network of cracks and fissures is produced, which leads to a more uniform cooling of the hydrocarbon mass as a whole. Because of this greater uniformity in cooling, the properties of the green coke produced will also be more nearly uniform.

An additional advantage of the present invention is that the cooled coke in the coking drum can be removed by means of water drills with greater safety than in prior art processes. When cooling water is introduced into the bottom only of a coking drum in accordance with prior art procedures, the water tends to channel thereby allowing hot spots to remain in the coke mass. These hot spots represent a significant danger to operating personnel attempting to remove coke from a coking drum by water drilling since great amounts of high pressure steam can be produced. In accordance with the present invention, this danger is substantially reduced since the greater network of fissures and paths into the hydrocarbon mass realized when the cooling water is supplied from the multiple entry orifices of the present invention significantly reduces the occurance of hot spots.

Still another advantage of the present invention resides in a reduction of stress to the structure of the coking drum. Because of the tendency of cooling water supplied to the bottom of a coking drum to channel, the drum itself may be cooled during coke cooling in a non-uniform manner. In this regard, it has been observed that conventional coking drums may actually assume a "banana" configuration during the liquid cooling operation because one side of the coking drum cools off at a faster rate than the other side. This introduces unwanted stresses into the coking drum and shortens the useful life of the apparatus. In accordance with the present invention, this disadvantage is avoided because cooling liquid is introduced uniformly resulting in the uniform cooling of the coking drum.

Although only a single embodiment of the present invention has been described above, it should be appreciated that many modifications can be made without departing from the spirit and scope of the invention. For example, orifices 58 can be arranged in three, four, five or more vertically spaced levels if desired. Also, the individual orifices 58 in successive levels can be arranged in rows as shown in the illustrated embodiment or they can be staggered if desired. Indeed, any arbitrary arrangement of orifices 58 can be employed so long as they charge cooling liquid into the interior of the cooling drum in a pattern which uniformly distributes the cooling effect provided by the liquid.

Although only a single embodiment in the present invention has been described above, many modifications can be made without departing from the spirit and scope of the invention. All such modifications are intended to be included in the scope of the present invention, which is to be limited only by the following claims.

I claim:

1. In a process for producing coke in which (a) a liquid hydrocarbon is charged into a coking drum having a top, bottom and lateral surfaces therebetween, (b) the liquid hydrocarbon is allowed to transform itself into coke, (c) the coke in said coking drum is cooled by introducing a cooling liquid into said coking drum, and (d) the coke in said coking drum is broken into pieces by breakup means insertable through the top of said coking drum and removed from said coking drum as green coke, the improvement comprising directing at least a portion of said cooling liquid at the coke in said coking drum during step (c) from plurality of vertically and horizontally spaced orifices located on the lateral surfaces of said drum so as to uniformly distribute the cooling effect provided by said cooling liquid to the coke in said coking drum.

2. The process of claim 1 wherein a portion of said cooling liquid is introduced into said coking drum from the bottom of said coking drum.

3. The process of claim 2 further comprising introducing steam into said coking drum after said liquid hydrocarbon is charged into said coking drum and before cooling liquid is introduced into said coking drum, said steam being introduced into said coking drum from said plurality of orifices and from said bottom.

4. The process of claim 1 further comprising introducing steam into said coking drum after liquid hydrocarbon is charged into said coking drum and before cooling liquid is introduced into said coking drum, said steam being introduced into said coking drum from said plurality of orifices.

5. The process of claim 1 wherein said cooling liquid is water.

6. The process of claim 1 wherein said liquid hydrocarbon is rich in aromatics whereby said green coke is a graphite-based green coke.

7. In an apparatus for producing coke from a liquid hydrocarbon comprising a coking drum having a top, a bottom and lateral surfaces therebetween, charging means for charging said liquid hydrocarbon into said coking drum for forming coke, cooling means for cooling the coke in said coking drum by means of a cooling liquid and breakup means insertable through the top of said coking drum for breaking up the coke in said coking drum into pieces thereby forming said coke, the improvement wherein said cooling means includes means for directing cooling liquid into the interior of said coking drum from a plurality of vertically and horizontally spaced orifices located at the lateral surfaces of said coking drum so as to uniformly distribute the cooling effect provided by said cooling liquid to the coke in said coking drum.

8. The apparatus of claim 7 wherein said breakup means comprises at least one water drill.

9. The apparatus of claim 7 wherein said means for directing coolign liquid further comprises a plurality of valves for individually controlling the flow of cooling liquid through each of said plurality of orifices.

10. The apparatus of claim 9 further comprising means for supplying steam to said plurality of orifices.

11. The apparatus of claim 7 further comprising means for supplying steam to said plurality of orifices.

* * * * *